US011227566B2

(12) United States Patent
Sun et al.

(10) Patent No.: US 11,227,566 B2
(45) Date of Patent: Jan. 18, 2022

(54) METHOD FOR REDUCING BRIGHTNESS OF IMAGES, A DATA-PROCESSING APPARATUS, AND A DISPLAY APPARATUS

(71) Applicant: BOE TECHNOLOGY GROUP CO., LTD., Beijing (CN)

(72) Inventors: Gaoming Sun, Beijing (CN); Yuxin Bi, Beijing (CN); Chengte Lai, Beijing (CN); Quan Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 916 days.

(21) Appl. No.: 15/777,605

(22) PCT Filed: Nov. 10, 2017

(86) PCT No.: PCT/CN2017/110369

§ 371 (c)(1),
(2) Date: May 18, 2018

(87) PCT Pub. No.: WO2018/214414

PCT Pub. Date: Nov. 29, 2018

(65) Prior Publication Data

US 2021/0174762 A1 Jun. 10, 2021

(30) Foreign Application Priority Data

May 22, 2017 (CN) ..... 201710368414.3

(51) Int. Cl.
*G09G 5/10* (2006.01)
*G09G 3/20* (2006.01)

(52) U.S. Cl.
CPC ..... *G09G 5/10* (2013.01); *G09G 3/2007* (2013.01); *G09G 2320/066* (2013.01);
(Continued)

(58) Field of Classification Search
CPC ..... G09G 5/10; G09G 3/2007; G09G 2320/0626; G09G 2320/066; G09G 2330/021; G09G 2340/16
See application file for complete search history.

(56) References Cited

U.S. PATENT DOCUMENTS

2007/0053607 A1* 3/2007 Mitsunaga ..... H04N 9/69 382/274
2008/0199074 A1* 8/2008 Mitsunaga ..... H04N 21/4402 382/169

(Continued)

*Primary Examiner* — Amare Mengistu
*Assistant Examiner* — Jennifer L Zubajlo
(74) *Attorney, Agent, or Firm* — Intellectual Valley Law, P.C.

(57) ABSTRACT

The present application discloses a method for reducing brightness of images at least partially. The method includes determining a grayscale mapping table corresponding to a previous frame of image and adjusting grayscale value of each pixel of a current frame of image based on the grayscale mapping table to enhance a contrast ratio to determine an after-adjust grayscale value of each pixel of the current frame of image. Furthermore, the method includes determining one or more coefficients of grayscale reduction based on the after-adjust grayscale value of each pixel of the current frame of image. Moreover, the method includes reducing grayscale value of each pixel of a next frame of image based on the one or more coefficients of grayscale reduction and after-adjust grayscale values of corresponding pixels of the next frame of image.

8 Claims, 4 Drawing Sheets

(52) U.S. Cl.
CPC ..... *G09G 2320/0626* (2013.01); *G09G 2330/021* (2013.01); *G09G 2340/16* (2013.01)

(56) References Cited

U.S. PATENT DOCUMENTS

2010/0080459 A1* 4/2010 Dai ..... G06T 5/40
382/170
2013/0100294 A1* 4/2013 Wu ..... H04N 5/33
348/164
2016/0086529 A1* 3/2016 Myers ..... G09G 3/3413
345/691
2021/0092461 A1* 3/2021 Gadgil ..... H04N 19/186

* cited by examiner

METHOD FOR REDUCING BRIGHTNESS OF IMAGES, A DATA-PROCESSING APPARATUS, AND A DISPLAY APPARATUS

CROSS-REFERENCE TO RELATED APPLICATION

This application is a national stage application under 35 U.S.C. § 371 of International Application No. PCT/CN2017/110369, filed Nov. 10, 2017, which claims priority to Chinese Patent Application No. 201710368414.3, filed May 22, 2017, the contents of which are incorporated by reference in the entirety.

TECHNICAL FIELD

The present invention relates to display technology, more particularly, to a method for reducing brightness of images displayed by a display panel, a data-processing apparatus, and a display apparatus having the same.

BACKGROUND

Organic light-emitting diode (OLED) display has many applications due to its advantages in fast response speed, wide color gamut, broad viewing angles, high brightness, and low weight. Especially, in the virtual reality (VR) technology field, the OLED display panel is often used as a screen for VR image display. Developments of OLED display itself move fast to push for higher display resolution from High Definition (HD), to Full High Definition (FHD), and further to Quad High Definition (QHD) and faster scan frequency from 60 Hz, to 90 Hz, and to 120 Hz. With such high display resolution and fast scan frequency being set, the power consumption of the display apparatus also increases a lot. As a VR equipment usually is powered by battery which is constrained by limited battery life, the application time of the VR equipment is greatly reduced due to the high power consumption of the display.

Reducing power consumption of an OLED display by directly reducing brightness of displayed image would be a major approach for reducing power consumption of the VR equipment to enhance its performance. It is desired to develop techniques to reduce brightness level of displayed images without sacrificing image contrast and flexibility of adjustment.

SUMMARY

In an aspect, the present disclosure provides a method for reducing brightness of images at least partially displayed in a display apparatus panel. The method includes determining a grayscale mapping table corresponding to a previous frame of image. The method further includes adjusting grayscale value of each pixel of a current frame of image based on the grayscale mapping table corresponding to the previous frame of image to enhance a contrast ratio to determine an after-adjust grayscale value of each pixel of the current frame of image. Additionally, the method includes determining one or more coefficients of grayscale reduction based on the after-adjust grayscale value of each pixel of the current frame of image. Furthermore, the method includes reducing grayscale value of each pixel of a next frame of image based on the one or more coefficients of grayscale reduction and after-adjust grayscale values of corresponding pixels of the next frame of image.

Optionally, the determining one or more coefficients of grayscale reduction based on the after-adjust grayscale value of each pixel of the current frame of image includes determining a grayscale distribution of the current frame of image including an average grayscale value, a maximum grayscale value, and a minimum grayscale value among all pixels of the current frame of image after adjusting grayscale values.

Optionally, the determining one or more coefficients of grayscale reduction includes determining whether the grayscale distribution of the current frame of image meets a first criterion, and if the first criterion is met, determining a coefficient of grayscale reduction for at least some pixels of a next frame of image based on the average grayscale value and a correspondence relationship between different ranges of the average grayscale value and different preset coefficient of grayscale reduction values.

Optionally, the determining one or more coefficients of grayscale reduction includes determining whether the grayscale distribution meets a second criterion, and if the second criterion is met, determining different values of the coefficient of grayscale reduction respectively of each pixel in different grayscale ranges of the next frame of image based on a correspondence relationship between the different grayscale ranges of the next frame of image and different preset coefficient of grayscale reduction values.

Optionally, the first criterion is met if the average grayscale value is smaller than a first threshold value, or if the average grayscale value is equal to or greater than a first threshold value and if a ratio of a difference between the maximum grayscale value and the minimum grayscale value over the maximum grayscale value is equal to or smaller than a second threshold value.

Optionally, the coefficient of grayscale reduction is determined to be the preset coefficient of grayscale reduction value corresponding to the range of the average grayscale value of the current frame of image. The higher is the range of the average grayscale value, the smaller is the preset coefficient of grayscale reduction value.

Optionally, the second criterion is met if the average grayscale value is equal to or greater than a first threshold value and if a ratio of a difference between the maximum grayscale value and the minimum grayscale value over the maximum grayscale value is greater than a second threshold value.

Optionally, the determining one or more coefficients of grayscale reduction includes, after determining the second criterion is met, determining an after-adjust grayscale value of each pixel of the next frame of image and determining a first grayscale range with high grayscale values corresponding to a first group of pixels of a next frame of image, a second grayscale range with low grayscale values corresponding to a second group of pixels of the next frame of image, and a third grayscale range between the first range and the second range corresponding to a remaining group of pixels of the next frame of image.

Optionally, the determining one or more coefficients of grayscale reduction further includes obtaining a first preset coefficient of grayscale reduction value corresponding to the first grayscale range, a second preset coefficient of grayscale reduction value corresponding to the second grayscale range, and a third preset coefficient of grayscale reduction value corresponding to the third grayscale range. The first preset coefficient of grayscale reduction value is smaller than the third preset coefficient of grayscale reduction value which is smaller than the second preset coefficient of grayscale reduction value. The first preset coefficient of grayscale reduction value, the second preset coefficient of grayscale reduction value, and the third preset coefficient of grayscale reduction value are determined to be the coefficient of grayscale reduction respectively of pixels in the first grayscale range, the second grayscale range, and the third grayscale range of the next frame of image.

Optionally, the first grayscale range is from 255×(1−a) to 255 in grayscale and the second grayscale range is from 0 to 255×a in grayscale, where a is a constant smaller than 1.

Optionally, the determining a grayscale mapping table includes determining a grayscale histogram of a frame of image; performing equalization to the grayscale histogram to obtain an equalized grayscale histogram and a dynamic range extension parameter and determining the grayscale mapping table based on the equalized grayscale histogram and the dynamic range extension parameter.

Optionally, the adjusting grayscale value of each pixel of a current frame of image includes providing an adjustment ratio corresponding to each grayscale value in the grayscale mapping table and adjusting the grayscale value of each pixel of a current frame of image based on the adjustment ratio and the grayscale value in the grayscale mapping table.

In another aspect, the present disclosure provides a data-processing apparatus for reducing brightness of images at least partially displayed in a display apparatus. The data-processing apparatus includes a first processor configured to determine a grayscale mapping table corresponding to the previous frame of image. The data-processing apparatus further includes a first adjuster coupled to the first processor and configured to adjust grayscale value of each pixel of a current frame of image based on the grayscale mapping table corresponding to the previous frame of image to enhance a contrast ratio. Additionally, the data-processing apparatus includes a second processor coupled to the first adjuster and configured to determine an after-adjust grayscale value of each pixel of the current frame of image. Furthermore, the data-processing apparatus includes a third processor coupled to the second processor and configured to determine one or more coefficients of grayscale reduction based on the after-adjust grayscale value of each pixel of the current frame of image. Moreover, the data-processing apparatus includes a second adjuster coupled to the third processor and configured to reduce grayscale value of each pixel of a next frame of image based on the one or more coefficients of grayscale reduction and after-adjust grayscale values of corresponding pixels of the next frame of image.

Optionally, the first processor is configured to receive pixel data of a previous frame of image to deduce a grayscale histogram of the previous frame of image.

Optionally, the second processor is configured to output a grayscale distribution of the current frame of image based on which an average grayscale value, a maximum grayscale value, and a minimum grayscale value are determined.

Optionally, the third processor is configured to determine that the grayscale distribution of the current frame of image meets a first criterion based on which a coefficient of grayscale reduction is determined to be a single preset coefficient of grayscale reduction value for all pixels of the next frame of image corresponding to the average grayscale value, or to determine that the grayscale distribution meets a second criterion based on which the one or more coefficients of grayscale reduction are determined to be respective multiple preset coefficient of grayscale reduction values for each pixel in corresponding different grayscale ranges of the next frame of image.

Optionally, the third processor is configured to determine that the first criterion is met when the average grayscale value is smaller than a first threshold value, or when the average grayscale is equal to or greater than the first threshold value and a ratio of a difference between the maximum grayscale value and the minimum grayscale value over the maximum grayscale value is equal to or smaller than the second threshold value; or to determine that the second criterion is met when the average grayscale value is equal to or greater than the first threshold value and a ratio of a difference between the maximum grayscale value and the minimum grayscale value over the maximum grayscale value is greater than the second threshold value.

Optionally, the third processor is configured to store a first group of preset coefficient of grayscale reduction values corresponding to different ranges of the average grayscale value, wherein a higher range of the average grayscale value corresponds to a smaller preset coefficient of grayscale reduction value in the first group associated with the first criterion, and store a second group of preset coefficient of grayscale reduction values corresponding to different grayscale ranges of pixels of the current frame of image. A higher grayscale range corresponds to a smaller preset coefficient of grayscale reduction value in the second group associated with the second criterion.

Optionally, the first processor is configured to determine a grayscale histogram of the previous frame of image, to perform equalization to the grayscale histogram to obtain an equalized grayscale histogram and a dynamic range extension parameter, and to determine the grayscale mapping table based on the equalized grayscale histogram and the dynamic range extension parameter.

In another aspect, the present disclosure provides a display apparatus including a data-processing apparatus described herein for reducing brightness of images at least partially displayed thereof.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

It is desired to reduce brightness of displayed image to achieve reduction of power consumption of a display apparatus yet without reducing image contrast or affecting image quality. Accordingly, the present disclosure provides, inter alia, a method for reducing brightness of images displayed by a display panel and a display apparatus having the same that substantially obviate one or more of the problems due to limitations and disadvantages of the related art.

Figure 1:
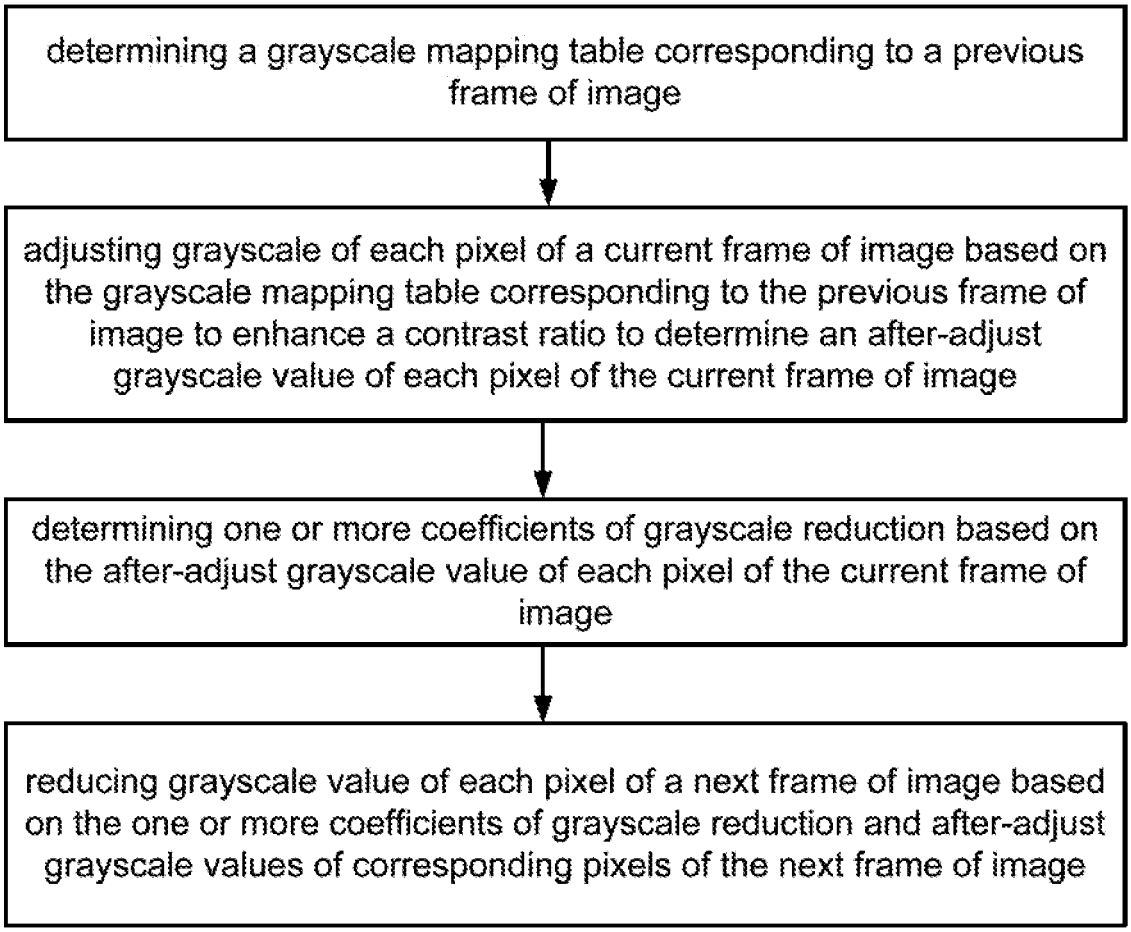
FIG. 1 is a flow chart illustrating a method for reducing brightness of sequentially displayed frames of images according to some embodiments of the present disclosure.

In one aspect, the present disclosure provides a method for reducing brightness of images at least partially displayed by a display panel. FIG. 1 shows a flow chart illustrating the method according to some embodiments of the present disclosure. Referring to FIG. 1, the method includes determining a grayscale mapping table corresponding to a previous frame of image. Additionally, the method includes adjusting grayscale value of each pixel of a current frame of image based on the grayscale mapping table to enhance a contrast ratio to determine an after-adjust grayscale value of each pixel of the current frame of image. Furthermore, the method includes determining one or more coefficients of grayscale reduction based on the after-adjust grayscale value of each pixel of the current frame of image. Moreover, the method includes reducing grayscale of each pixel of a next frame of image based on the one or more coefficients of grayscale reduction. Optionally, reducing grayscale of the next frame of image is achieved based on the one or more coefficients of grayscale reduction and after-adjust grayscale values of corresponding pixels of the next frame of image.

In some embodiments, the method of reducing brightness of a displayed image is executed on a basis that the contrast ratio of the displayed image after the brightness reduction is enhanced (or at least is not reduced). So, when the next frame of image is displayed with each pixel grayscale being reduced, the contrast ratio of the displayed image is substantially not affected. In an embodiment, the method is to reduce grayscale of a next frame of image based on information of grayscale values of pixels of a current frame of image, i.e., using an adaptive adjustment for reducing grayscale of each frame of image with high flexibility.

Optionally, the method for adaptively reducing grayscale of frames of images at least partially displayed in a display panel can be applied to the electroluminescent display panel such as OLED display panel, and is also applicable to liquid crystal display panel. Other types of display panels that are capable of reducing power consumption through brightness reduction should be also applicable.

In an embodiment, for determining a grayscale mapping table corresponding to a previous frame of image and using the grayscale mapping table to adjust grayscale value of each pixel of a current frame of image, the method uses a grayscale histogram of the previous frame of image to determine the grayscale mapping table. In particular, the method includes determining a grayscale histogram of a previous frame of image, performing equalization to the grayscale histogram to obtain an equalized grayscale histogram and a dynamic range extension coefficient associated with the equalized grayscale histogram. Finally, the method includes determining a grayscale mapping table corresponding to the previous frame of image based on the equalized grayscale histogram and the dynamic range expansion coefficient.

Optionally, the method for determining the grayscale mapping table described herein can be implemented using a data-processing apparatus capable of receiving each frame of image data. Optionally, the data-processing apparatus includes at least a dual-terminal random access memory (RAM) that is configured to alternately receive each frame of image data at separate times. A frame of image data usually is in RGB format. The data-processing apparatus is configured to convert the image data in RGB format to grayscale YUV format based on which a grayscale histogram is generated. Optionally, the data-process apparatus includes multiple RAMs to operate in alternative times to effectively prevent interference of adjacent frames of image data from causing reading/writing conflict from one frame to next. Additionally, when each RAM finishes a statistical processing on each frame of image data, it will automatically clear its internal data and be ready to receive and process a next frame of image data, preventing interference of adjacent frames of image data in each RAM.

Optionally, the method of determining a grayscale mapping table includes alternatively using an histogram average and a weight of dynamic range extension in addition to using the equalized grayscale histogram and an associated dynamic range extension parameter. Optionally, the method includes obtaining the dynamic range extension parameter based on an input current threshold and grayscale histogram variance. The input current threshold is a fixed value preset based on resolution of the displayed image. Based on the dynamic range extension parameter, the weight of the dynamic range extension is determined.

Optionally, the method includes obtaining histogram average based on the grayscale histogram and the equalized grayscale histogram.

Figure 2:
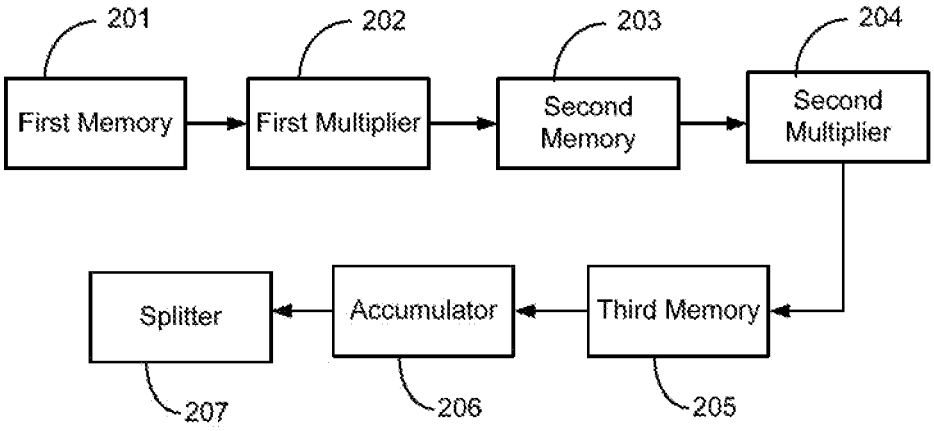
FIG. 2 is a block diagram of a data processor for deducing a grayscale mapping table of a displayed image according to an embodiment of the present disclosure.

In an embodiment, the data-processing apparatus includes three memory devices. FIG. 2 shows a block diagram of a data processor for deducing a grayscale mapping table of a displayed image according to an embodiment of the present disclosure. Referring to FIG. 2, the data processor includes a first memory 201 for receiving a histogram average value and an equalized grayscale histogram. The data processor includes a first multiplier 202 coupled to the first memory 201. The first memory 201 is configured to send input brightness data including the histogram average value and the equalized grayscale histogram to the first multiplier 202 to perform iterative calculations of the input brightness data and send a result of $1^{st}$-processed brightness data as input data to a second memory 203 which is coupled to the first multiplier 202. The second memory 203 is configured to process the input data to obtain pre-treatment data as another input data sent to a second multiplier 204 for further iterative calculations. The result of $2^{nd}$-processed brightness data as input data for a third memory 205 to process the $2^{nd}$-processed brightness data to obtain an optimized grayscale histogram. The optimized grayscale histogram is then sent to an accumulator 206 to perform an accumulation calculation and send a result to a splitter 207. The splitter 207 is configured to split the result of the accumulation calculation to obtain the grayscale mapping table. Of course, the above method is merely an example of determining the grayscale mapping table.

Referring to FIG. 1, the method of adjusting grayscale value of each pixel of a current frame of image includes enhancing a contrast ratio of the current frame of image based on the grayscale mapping table obtained for the previous frame of image. In particular, the grayscale mapping table includes a correspondence between a grayscale value and an adjustment ratio, based on which a grayscale value of each pixel of the current frame of image is adjusted. Contrast ratio is enhanced for selectively increasing grayscale values of some pixels with higher grayscale values and decreasing grayscale values of some other pixels with lower grayscale values based on the corresponding adjustment ratio. Optionally, the adjustment ratio is obtained through a histogram normalization process.

Optionally, the method of adjusting grayscale value of each pixel of the current frame of image includes a smoothening process to all the grayscale values to eliminate certain noises in pixels near boundary or intersection.

Referring to FIG. 1, the method of determining the after-adjust grayscale value of each pixel of the current frame of image includes determining an average grayscale value, a maximum grayscale value, and a minimum grayscale value among all pixels of the current frame of image. In other words, a grayscale distribution for the whole current frame of image is obtained after the previous step of adjusting grayscale value.

Optionally, the method of determining the maximum grayscale value and the minimum grayscale value of the after-adjust grayscale values of all pixels of the current frame of image includes determining different ranges of grayscale values of the pixels of the current frame of image. For example, assuming that a grayscale range for the after-adjust grayscale values of the current frame of image is 0-255, a first grayscale range of 255×(1−a)-255 is determined to be a high grayscale range and a second grayscale range of 0-255×a is determined to be a low grayscale range, where a is a positive number smaller than 1. A maximum grayscale value of pixels within the high grayscale range is determined to be the maximum grayscale value of the after-adjust grayscale values of all pixels of the current frame of image. Similarly, a minimum grayscale value of pixels within the low grayscale range is determined to be the minimum grayscale value of the after-adjust grayscale values of all pixels of the current frame of image. Optionally, for each frame of image corresponding to different grayscale ranges, e.g., 0-255, or 10-250, or 20-200, or others, the maximum grayscale value and the minimum grayscale value are determined each time based on the respective different grayscale ranges. Additionally, determining different ranges of grayscale values is applied to every frame of image as the method of brightness reduction is keeping on at the same time when the display panel is displaying one frame of image after another. Optionally, other specific method of determining grayscale ranges of pixels in each frame of image is possible.

Referring back to FIG. 1, after adjusting the grayscale value of each pixel of the current frame of image to determine an after-adjust grayscale value for each pixel and associated grayscale distribution including an average grayscale value, a maximum grayscale value, and a minimum grayscale value, the method is executed further for determining one or more coefficients of grayscale reduction based on the after-adjust grayscale value of each pixel. In particular, the method includes determining whether the grayscale distribution associated with the after-adjust grayscale values of all pixels of the current frame of image meets a first criterion or a second criterion, and based on which criterion is met one or more coefficients of grayscale reduction can be obtained.

In an embodiment, when the grayscale distribution is determined to meet a first criterion, a coefficient of grayscale reduction will be determined based on a correspondence relationship between the average grayscale value and a preset coefficient of grayscale reduction value. The coefficient of grayscale reduction will be used to reduce after-adjust grayscale values of all pixels of a next frame of image. When the grayscale distribution is determined to meet a second criterion, one or more coefficients of grayscale reduction will be determined based on a correspondence relationship between different grayscale ranges of pixels of a next frame of image and different preset coefficient of grayscale reduction values. The one or more coefficients will be used respectively to reduce after-adjust grayscale values of each pixel in different grayscale ranges of the next frame of image.

In a specific embodiment, the first criterion is set for those displayed images with small average grayscale value or with small grayscale variation among all pixels of a frame of image. In particular, the first criterion is met when the average grayscale value is in a range smaller than a first threshold value. For the current frame of image after adjusting grayscale value, an average grayscale value is obtained which may be in a certain value range. A correspondence relationship between different value ranges of the average grayscale value and different preset coefficient of grayscale reduction values can be pre-stored in a memory device. Based on the correspondence relationship and the value range of the current average grayscale value, a corresponding preset coefficient of grayscale reduction value can be deduced which is determined to be the coefficient of grayscale reduction. In an embodiment, the correspondence relationship is a negative correlation relationship, e.g., the larger of the average grayscale value is, the smaller of the preset coefficient of grayscale reduction value. In Table 1 below, M represents average grayscale value and θ represents preset coefficient of grayscale reduction value. For example, when the average grayscale value M is greater than or equal to 40 and smaller than 60, the corresponding preset coefficient of grayscale reduction value θ is 0.98. When the average grayscale value M is greater than or equal to 200 and smaller than 220, the corresponding preset coefficient of grayscale reduction value θ is 0.78.

TABLE 1

| Average Grayscale Value M | Preset Coefficient of Grayscale Reduction θ |
|---|---|
| 220 > M ≥ 200 | 0.78 |
| 200 > M ≥ 180 | 0.80 |
| 180 > M ≥ 140 | 0.82 |
| 140 > M ≥ 120 | 0.86 |
| 120 > M ≥ 100 | 0.88 |
| 100 > M ≥ 80 | 0.90 |
| 80 > M ≥ 60 | 0.95 |
| 60 > M ≥ 40 | 0.98 |

Of course, Table 1 is merely an example. Other values θ can be set for the preset coefficient of grayscale reduction values in the second column in the Table 1. Correspondingly, the average grayscale value M can also be set differently. Alternatively, the first criterion is also met when the average grayscale value is equal to or greater than the first threshold value and additionally when a ratio of a difference between the maximum grayscale value and the minimum grayscale value over the maximum grayscale value is equal to or smaller than a second threshold value. For example, when the average grayscale value M is greater than or equal to 220 but the grayscale variation among all pixels of the frame of image is small, the preset coefficient of grayscale reduction may be assigned as 0.75 (not shown in Table 1).

In an embodiment, the second criterion is set for those displayed images with high average grayscale value and relative large grayscale variation among all pixels in a frame of image. In particular, the second criterion is met if the average grayscale value is equal to or greater than the first threshold value and if a ratio of a difference between the maximum grayscale value and the minimum grayscale value over the maxim grayscale value is greater than a second threshold value. In this case, the method including determining different grayscale ranges of grayscale values of pixels of a next frame of image after adjusting grayscale value (to enhance contrast ratio). Then, the method includes determining a first grayscale range with high grayscale values corresponding to a first group of pixels of a next frame of image, a second grayscale range with low grayscale values corresponding to a second group of pixels of the next frame of image, and a third grayscale range between the first range and the second range corresponding to a remaining group of pixels of the next frame of image. For example, assuming that all pixels of the next frame of image correspond to a grayscale range 0-255, the first group of pixels corresponding to a high grayscale range of 255×(1−a)-255 is in the first grayscale range, the second group of pixels corresponding to a low grayscale range of 0-255×a is in the second grayscale range, and the third group of pixels will be in the third grayscale range between the first grayscale range and the second grayscale range, here a is positive and smaller than 1. In other words, the order of grayscale values in the three grayscale ranges from large to small is: the first grayscale range (high grayscale)>the third grayscale range (middle grayscale)>the second grayscale range (low grayscale).

Accordingly, the correspondence relationship between the different grayscale ranges and different preset coefficient of grayscale reduction values is defined and pre-stored in a memory of a data-processing apparatus, and retrieved by the data-processing apparatus for determining different coefficient of grayscale reduction for pixels in different grayscale ranges of one frame of image as the second criterion is met. In the embodiment, the first preset coefficient of grayscale reduction value $\alpha$ is obtained corresponding to the first grayscale range, a second preset coefficient of grayscale reduction value $\beta$ is obtained corresponding to the second grayscale range, and a third preset coefficient of grayscale reduction value $\gamma$ is obtained corresponding to the third grayscale range. Usually, this correspondence relationship is a negative correlation relationship, i.e., the higher of grayscale value is in a grayscale range, the smaller of the preset coefficient of grayscale reduction value is set. Corresponding to the three different grayscale ranges from high to low, the order of preset coefficient of grayscale reduction values from small to larger is; $\alpha<\gamma<\beta$. Finally, the first preset coefficient of grayscale reduction value $\alpha$, the second preset coefficient of grayscale reduction value $\beta$, and the third preset coefficient of grayscale reduction value $\gamma$ are determined to be the coefficient of grayscale reduction respectively for reducing grayscale values of pixels in the first grayscale range, the second grayscale range, and the third grayscale range of the next frame of image. In particular, when reducing grayscale values of pixels of the next frame of image, the grayscale values of pixels in the first or high grayscale range are multiplied with the first coefficient of grayscale reduction $\alpha$, the grayscale values of pixels in the second or low grayscale range are multiplied with the second coefficient of grayscale reduction $\beta$, and the grayscale values of pixels in the third (or medium) grayscale range are multiplied with the third coefficient of grayscale reduction $\gamma$.

Optionally, the first threshold value used to define the first criterion is obtained by performing a power consumption calculation for a display panel. By comparing the average grayscale value obtained for each frame of image during the operation with the first threshold value, the power consumption of the display panel can be directly determined. Then, the method can be executed to properly adjust grayscale values of images displayed by the display panel. Generally, the first threshold value may be set to a grayscale value of 220. Of course, other values like 200, or 240 can be used.

Optionally, the second threshold value is determined based on grayscale variation in a whole frame of image. Unlike the first threshold value, the second threshold value is not deduced based on the power consumption. The second threshold value is a percentage value used to determine a degree of grayscale variation in a whole frame of image. Generally, the second threshold value is set to 5%, or can be set to 10%, or 2% or other percentages. In an example that the second threshold value is set to 5%, when a ratio of a difference between the maximum grayscale value and the minimum grayscale value over the maximum grayscale value is greater than 5%, it indicates that the grayscale variation of this frame of image is large. When the above ratio is not greater than 5%, it indicates that the grayscale variation of this frame of image is relatively small.

Figure 3A:
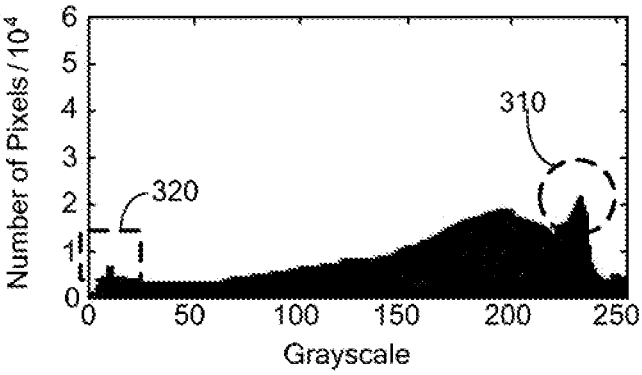
FIG. 3A is a grayscale histogram of a displayed image before using the method herein.
Figure 3B:
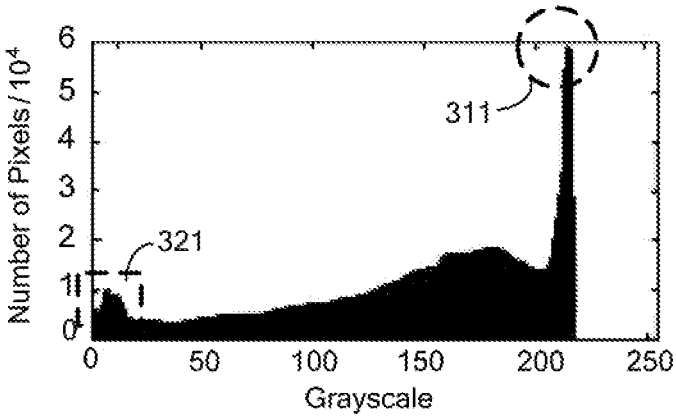
FIG. 3B is a grayscale histogram of a displayed image after using the method herein according to an embodiment of the present disclosure.

In a specific embodiment, after determining one or more coefficients of grayscale reduction, the grayscale values of pixels of the next frame of image can be reduced accordingly based on the one or more coefficients of grayscale reduction. FIG. 3A shows a grayscale histogram of a displayed image before using the method herein. FIG. 3B shows a grayscale histogram of a displayed image after using the method herein according to an embodiment of the present disclosure. Referring to FIG. 3A and FIG. 3B, horizontal coordinate represents grayscale value and vertical coordinate represents number of pixels with corresponding grayscale value. The larger of the vertical coordinate at a certain horizontal coordinate, there are more pixels with the corresponding grayscale value. After applying the method of brightness reduction described herein, some pixels with high grayscale values (around 255) disappear and number of pixels with relative low grayscale values in region 321 becomes higher than the number in region 320 before using the method. This means that the darker portion of original image now is enriched. Although some pixels near 255 grayscale level are removed, the number of pixels with relative higher grayscale (near the current maximum but smaller than 255) in region 311 is increased from the number in region 310 before using the method. This means that the brighter portion of original image now is also enriched, with overall brightness being reduced. Therefore, comparing FIG. 3B with FIG. 3A, it shows that applying the method of brightness reduction of the present disclosure properly reduces grayscale values of at least some pixels of a frame of image but does not cause bad impact on the contrast of the image. Instead, the contrast ratio is obviously enhanced, greatly improving quality of the displayed image.

Figure 4:
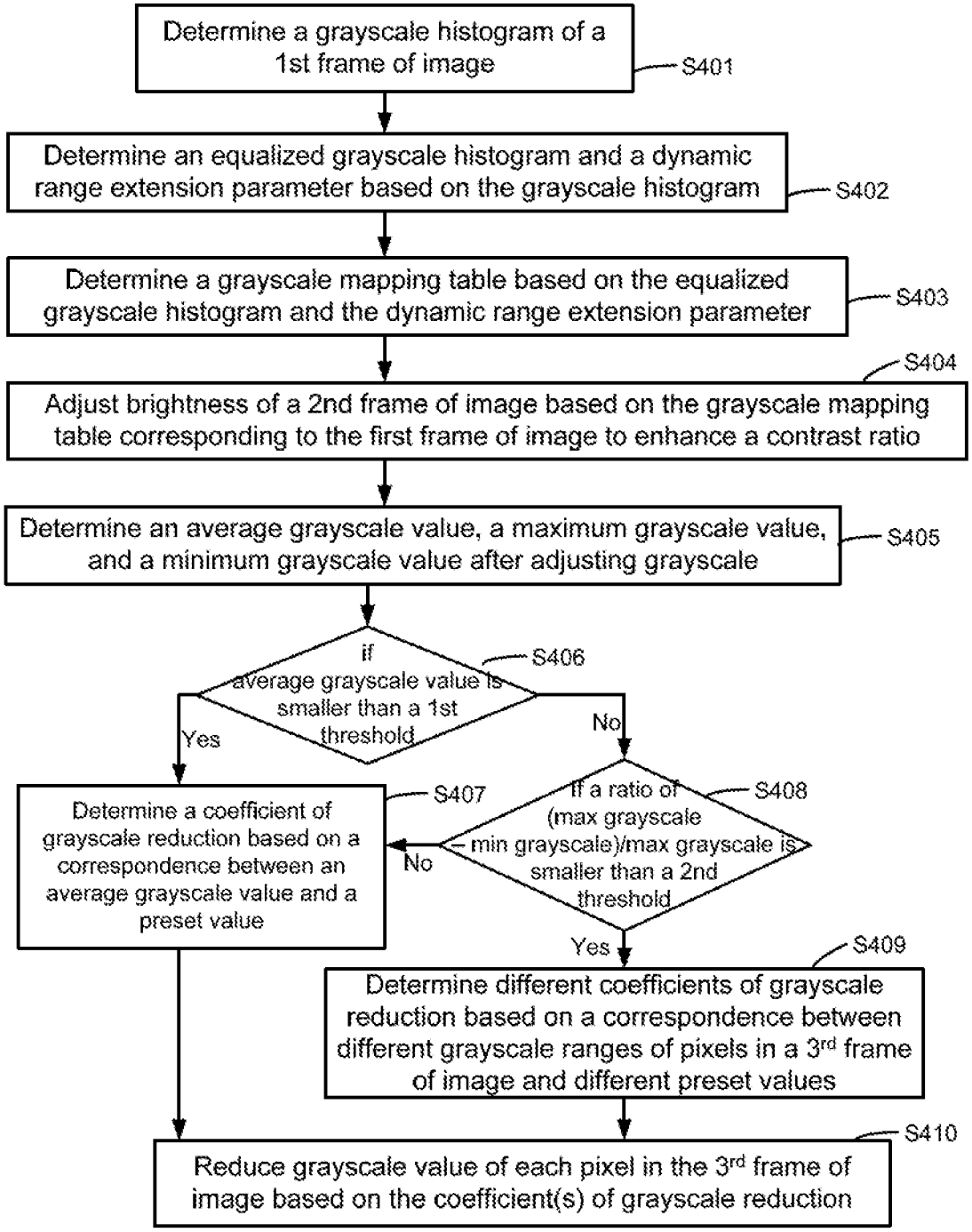
FIG. 4 is a flow chart illustrating a method for reducing brightness of sequentially displayed frames of images according to an embodiment of the present disclosure.
Figure 5:
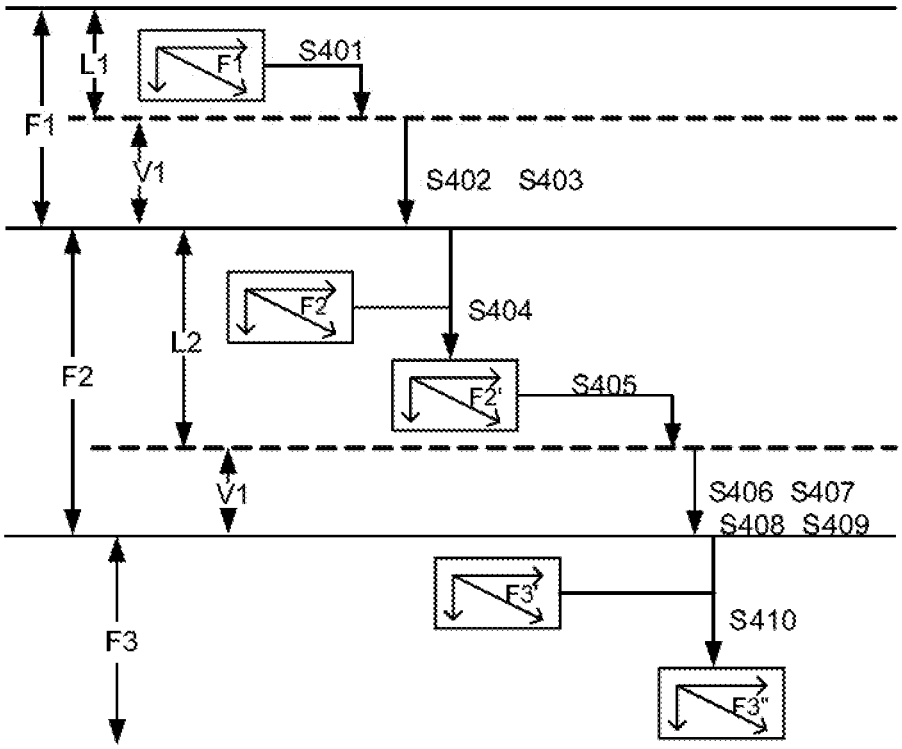
FIG. 5 is a schematic diagram illustrating the method of FIG. 4 for reducing brightness of sequentially displayed frames of images according to an embodiment of the present disclosure.

FIG. 4 is a flow chart illustrating a method for reducing grayscale of sequentially displayed frames of images according to an embodiment of the present disclosure. Here, the method is illustrated by implementing it to the first three frames of images as an example. Yet, the first frame of image can be any frame of image in a series of images sequentially displayed images. FIG. 5 is a schematic diagram illustrating the method of FIG. 4 for reducing grayscale values of sequentially displayed frames of images according to an embodiment of the present disclosure. Optionally, the first frame of image is a previous frame of image. The second frame of image is a current frame of image that is one consecutively displayed image next to the previous frame of image. The third frame of image is a next frame of image that is one consecutively displayed image next to the current frame of image.

Referring FIG. 5, F1 represents the first frame, L1 represents the display time of the first frame, V1 represents non-display time of the first frame; F2 represents the second frame, L2 represents the display time of the second frame, V2 represents non-display time of the second frame, F2' represents the second frame after adjusting grayscale value, F3 represents the third frame, F3' represents the third frame after adjusting grayscale value, and F3" represents the third frame after grayscale value reduction.

Referring to FIG. 4, the method includes a step S401 for determining a grayscale histogram of a 1st frame of image. The method also includes a step S402 for determining an equalized grayscale histogram and a dynamic range extension parameter based on the grayscale histogram. The method also includes a step S403 for determining a grayscale mapping table based on the equalized grayscale histogram and the dynamic range extension parameter. Additionally, the method includes a step S404 for adjusting grayscale values of a 2nd frame of image based on the grayscale mapping table corresponding to the first frame of image to enhance a contrast ratio. The method further includes a step S405 for determining an average grayscale value, a maximum grayscale value, and a minimum grayscale value after adjusting grayscale values.

Furthermore, referring to FIG. 4, the method includes a step S406 for determining if average grayscale value is smaller than a 1st threshold. If the step S406 is true, the method includes a step S407 for determining a coefficient of grayscale reduction based on a correspondence between an average grayscale value and a preset value. The average grayscale value obtained in the step S405 is used to find it belonging to a particular average grayscale value and deducing the corresponding preset value which is determined to be the coefficient of grayscale reduction. Optionally, the preset value is a positive number smaller than 1 and the coefficient of grayscale reduction is used as a multiplication factor intended for reducing grayscale value of each pixel in a frame of image.

Referring to FIG. 4, the method further includes, if the step S406 is not true, a step S408 of determining If a ratio of a difference between the maximum grayscale value and the minimum grayscale value over the maximum grayscale value is smaller than a 2nd threshold. If the step S408 is true, the method includes a step S409 for determining different coefficients of grayscale reduction based on a correspondence between different grayscale ranges of pixels in a 3rd frame of image and different preset values. The 3rd frame of image firstly is processed to adjust the grayscale value of each pixel based on a grayscale mapping table obtained based on the 2nd frame of image to enhance contrast ratio. The third frame of image secondly is processed to determine different groups of pixels in different grayscale ranges based on after-adjust grayscale value of each pixel. Then, the step 409 is performed to use the correspondence between different grayscale ranges of pixels in a 3rd frame of image and different preset values to deduce different coefficients of grayscale reduction corresponding to the different grayscale ranges.

Moreover, referring to FIG. 4, if the step S408 is not true, the step S407 is executed again for determining a coefficient of grayscale reduction based on a correspondence between an average brightness value and a preset value. This corresponds to a situation that the overall brightness of the displayed image is high but has a small variation. In this case, a single coefficient of grayscale reduction, usually with an even smaller value for achieving a larger brightness reduction, is assigned and intended for reducing grayscale values of at least some pixels of the 3rd frame of image.

Referring to FIG. 4, the method includes a step S410 for reducing grayscale value of each pixel in the 3rd frame of image based on the one or more coefficients of grayscale reduction. In some scenarios like the step S407, a single coefficient of grayscale reduction is obtained for reducing grayscale values of at least some pixels in the third frame of image. The specific value of the single coefficient of grayscale reduction is depended upon the average grayscale value obtained for the second frame of image. In other scenarios like the step S409, multiple (e.g., 3) different coefficients of grayscale reduction are obtained for respectively reducing grayscale values of pixels in different grayscale ranges of the third frame of image. The value of one of the multiple coefficients of grayscale reduction is large (means less brightness reduction) for pixels in the low grayscale range. The value of another of the multiple coefficients of grayscale reduction is small (means more brightness reduction) for pixels in the high grayscale range.

Figure 6:
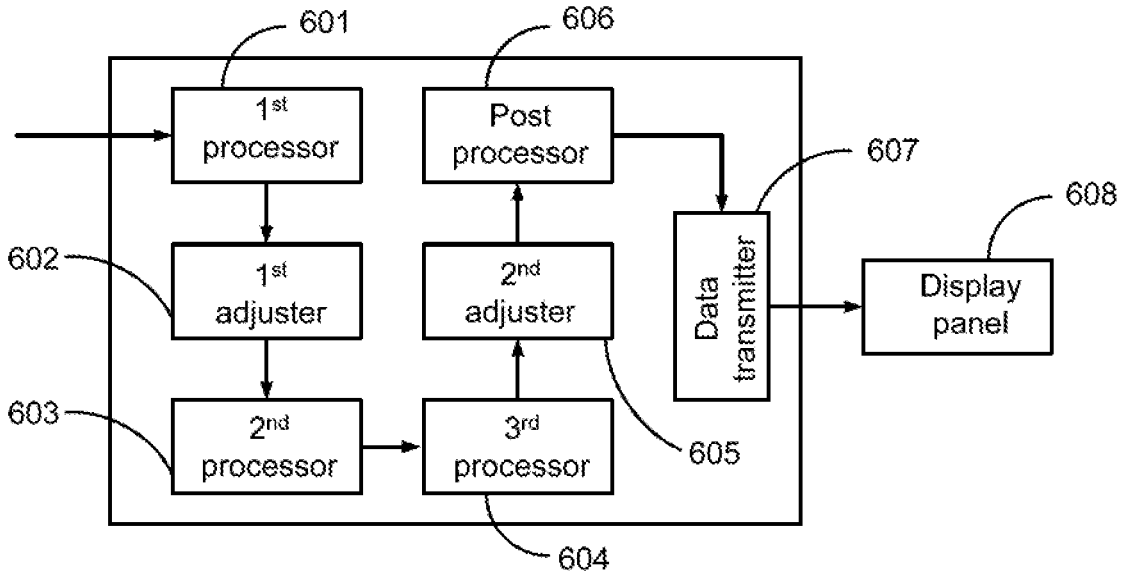
FIG. 6 is a block diagram of a data-processing apparatus for reducing brightness of displayed image according to an embodiment of the present disclosure.

In another aspect, the present disclosure provides a data-processing apparatus for reducing brightness of images at least partially displayed in a display apparatus using the method described herein. FIG. 6 is a block diagram of a data-processing apparatus for reducing brightness of a displayed image according to an embodiment of the present disclosure. Referring to FIG. 6, the data-processing apparatus includes a first processor 601 configured to receive pixel data of a previous frame of image to deduce a grayscale histogram thereof and to determine a grayscale mapping table corresponding to the previous frame of an image based on the grayscale histogram. The data-processing apparatus further includes a first adjuster 602 coupled to the first processor 601 and configured to adjust grayscale value of each pixel of a current frame of image based on the grayscale mapping table to enhance a contrast ratio. Additionally, the data-processing apparatus includes a second processor 603 coupled to the first adjuster 602 and configured to determine an after-adjust grayscale value of each pixel of the current frame of image. The data-processing apparatus further includes a third processor 604 coupled to the second processor 603 and configured to determine one or more coefficients of grayscale reduction. Furthermore, the data-processing apparatus includes a second adjuster 605 coupled to the third processor 604 and configured to reduce the after-adjust grayscale values of pixels in one or more grayscale ranges of a next frame of image based on the one or more coefficients of grayscale reduction.

Optionally, the data-processing apparatus is achieved its function using a field-programmable gate array (FPGA). Each of the first processor 601, the first adjuster 602, the second processor 603, the third processor 604, and the second adjustor 605 can be one of array of programmable logic blocks coupled in series via a reconfigurable interconnects that allow the blocks to be "wired together", like many logic gates that can be inter-wired in different configurations. They can be re-programmable on field for individual display apparatus that contains the data-processing apparatus.

In an embodiment, the second processor 603 is configured to output a grayscale distribution of after-adjust grayscale values of the current frame of image based on which an average grayscale value, a maximum grayscale value, and a minimum grayscale value are determined.

In an embodiment, the third processor 604 is configured to determine that the grayscale distribution meet a first criterion based on which a coefficient of grayscale reduction is determined to be a single preset coefficient of grayscale reduction value for at least some pixels of the next frame of image corresponding to the average grayscale value, or determine that the grayscale distribution data meet a second criterion based on which the one or more coefficients of grayscale reduction are determined to be respective multiple preset coefficient of grayscale reduction values for each pixel in corresponding different grayscale ranges of the next frame of image.

In an embodiment, the third processor 604 is configured to determine that the first criterion is met when the average grayscale value is smaller than a first threshold value or when the average grayscale value is equal to or greater than the first threshold value and a ratio of a difference between the maximum grayscale value and the minimum grayscale value over the maximum grayscale value is equal to or smaller than the second threshold value. Or, the third processor determines that the second criterion is met when the average grayscale value is equal to or greater than the first threshold value and a ratio of a difference between the maximum grayscale value and the minimum grayscale value over the maximum grayscale value is greater than the second threshold value. Optionally, the third processor 604 includes a comparator to perform the logic operation of determining if the first criterion is met or if the second criterion is met. Optionally, the third processor 604 includes a field-programmable gate array (FPGA) circuit for handing the logic operations. Optionally, the first threshold value is a preset grayscale value related to power consumption of the display apparatus. Optionally, the second threshold value is a percentage value for defining high or low grayscale ranges in one frame of image related to grayscale variation of the whole frame of image.

In an embodiment, the third processor 604 is configured to store a first group of preset coefficient of grayscale reduction values corresponding to different ranges of the average grayscale value. A higher range of the average grayscale value corresponds to a smaller preset coefficient of grayscale reduction value in the first group associated with the first criterion. The third processor is also configured to store a second group of preset coefficient of grayscale reduction values corresponding to different grayscale ranges of pixels of the current frame of image. A higher grayscale range corresponds to a smaller preset coefficient of grayscale reduction value in the second group associated with the second criterion. Optionally, the third processor 604 includes one or more random access memory RAM devices.

In an embodiment, the first processor 601 is configured to determine a grayscale histogram of the previous frame of image, to equalize the grayscale histogram to obtain a equalized grayscale histogram and a dynamic range extension parameter, and to determine the grayscale mapping table based on the equalized grayscale histogram and the dynamic range extension parameter. Optionally, the first processor 601 is a RAM-based data processor shown in FIG. 2, including multiple random access memories, multiple multipliers, a splitter, and an accumulator. Optionally, the RAM device is a dual-terminal RAM.

In an embodiment, after the second adjuster 605 is operated to reduce grayscale value of each pixel of the next frame of image, the brightness data of the next frame of image is transferred to a post processor 606 for converting the brightness data to corresponding RGB format. The RGB formatted image data is sent by a data transmitter 607 to a display panel 608 for displaying an image based on the RGB formatted data.

In another aspect, the present disclosure provides a display apparatus including a data-processing apparatus described herein for reducing brightness of images at least partially displayed thereof. The display apparatus can be a smart phone, a tablet computer, a television, a displayer, a notebook computer, a digital picture frame, a navigator, or any product or component having a display function.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A data-processing apparatus for reducing brightness of images at least partially displayed in a display apparatus, the data-processing apparatus comprising:

a first processor configured to determine a grayscale mapping table corresponding to the previous frame of image;

a first adjuster coupled to the first processor and configured to adjust grayscale value of each pixel of a current frame of image based on the grayscale mapping table corresponding to the previous frame of image to enhance a contrast ratio;

a second processor coupled to the first adjuster and configured to determine an after-adjust grayscale value of each pixel of the current frame of image;

a third processor coupled to the second processor and configured to determine one or more coefficients of grayscale reduction based on the after-adjust grayscale value of each pixel of the current frame of image; and a second adjuster coupled to the third processor and configured to reduce grayscale value of each pixel of a next frame of image based on the one or more coefficients of grayscale reduction and after-adjust grayscale values of corresponding pixels of the next frame of image.

2. The data-processing apparatus of claim 1, wherein the first processor is configured to receive pixel data of a previous frame of image to deduce a grayscale histogram of the previous frame of image.

3. The data-processing apparatus of claim 1, wherein the second processor is configured to output a grayscale distribution of the current frame of image based on which an average grayscale value, a maximum grayscale value, and a minimum grayscale value are determined.

4. The data-processing apparatus of claim 3, wherein the third processor is configured to determine that the grayscale distribution of the current frame of image meets a first criterion based on which a coefficient of grayscale reduction is determined to be a single preset coefficient of grayscale reduction value for all pixels of the next frame of image corresponding to the average grayscale value, or to determine that the grayscale distribution meets a second criterion based on which the one or more coefficients of grayscale reduction are determined to be respective multiple preset coefficient of grayscale reduction values for each pixel in corresponding different grayscale ranges of the next frame of image.

5. The data-processing apparatus of claim 4, wherein the third processor is configured to determine that the first criterion is met when the average grayscale value is smaller than a first threshold value, or when the average grayscale value is equal to or greater than the first threshold value and a ratio of a difference between the maximum grayscale value and the minimum grayscale value over the maximum grayscale value is equal to or smaller than the second threshold value; or to determine that the second criterion is met when the average grayscale value is equal to or greater than the first threshold value and a ratio of a difference between the maximum grayscale value and the minimum grayscale value over the maximum grayscale value is greater than the second threshold value.

6. The data-processing apparatus of claim 5, wherein the third processor is configured to store a first group of preset coefficient of grayscale reduction values corresponding to different ranges of the average grayscale value, wherein a higher range of the average grayscale value corresponds to a smaller preset coefficient of grayscale reduction value in the first group associated with the first criterion, and store a second group of preset coefficient of grayscale reduction values corresponding to different grayscale ranges of pixels of the current frame of image, wherein a higher grayscale range corresponds to a smaller preset coefficient of grayscale reduction value in the second group associated with the second criterion.

7. The data-processing apparatus of claim 1, wherein the first processor is configured to determine a grayscale histogram of the previous frame of image, to perform equalization to the grayscale histogram to obtain an equalized grayscale histogram and a dynamic range extension parameter, and to determine the grayscale mapping table based on the equalized grayscale histogram and the dynamic range extension parameter.

8. A display apparatus comprising a data-processing apparatus of claim 1 for reducing brightness of images at least partially displayed thereof.

* * * * *